US005879148A

United States Patent [19]

Cheng et al.

[11] Patent Number: 5,879,148

[45] Date of Patent: Mar. 9, 1999

[54] MECHANICAL SWIRLER FOR A LOW-$NO_X$, WEAK-SWIRL BURNER

[75] Inventors: Robert K. Cheng, Kensington; Derek T. Yegian, Berkeley, both of Calif.

[73] Assignee: The Regents of the University of California, Oakland, Calif.

[21] Appl. No.: 837,377

[22] Filed: Apr. 16, 1997

Related U.S. Application Data

[63] Continuation-in-part of Ser. No. 33,878, Mar. 19, 1993, Pat. No. 5,735,681.

[51] Int. Cl.[6] ..... F23D 14/62

[52] U.S. Cl. ..... 431/9; 431/350; 431/354

[58] Field of Search ..... 431/350, 353, 431/349, 326, 328, 329, 346, 355, 354, 8, 7, 9

[56] References Cited

U.S. PATENT DOCUMENTS

| | | | |
|---|---|---|---|
| 686,625 | 11/1901 | Machlet, Jr. | 431/349 |
| 733,235 | 7/1903 | Machlet, Jr. | 431/349 |
| 2,675,068 | 4/1954 | Gollus et al. | 431/349 |
| 2,888,980 | 6/1959 | Williams et al. | 431/349 |
| 4,021,188 | 5/1977 | Yamagishi et al. | 431/158 |
| 4,732,559 | 3/1988 | Pearl, II et al. | 431/355 |
| 5,720,606 | 2/1998 | Pfefferle | 431/326 |
| 5,735,681 | 4/1998 | Cheng | 431/10 |

OTHER PUBLICATIONS

J. M. Beer and N. A. Chigier, "Swirling Flows", 1983*Combustion Aerodynamics*.

D. T. Yegian and R. K. Cheng, "Development of a Vane–Swirler for Use In a Low $NO_x$ Weak–Swirl Burner", 1996, Presented at the *American Flame Research Committee 1996, International Symposium*, Baltimore, Maryland, Oct. 2, 1996.

F. O'Young and R. W. Bilger, "Measurement of Scalar Dissipation in Premixed Flames", 1996, *Combustion Science Technology* vol. 113–114, pp. 393–411.

*Primary Examiner*—Carl D. Price
*Attorney, Agent, or Firm*—Beyer & Weaver, LLP

[57] ABSTRACT

Disclosed is a mechanical swirler for generating diverging flow in lean premixed fuel burners. The swirler of the present invention includes a central passage with an entrance for accepting a feed gas, a flow balancing insert that introduces additional pressure drop beyond that occurring in the central passage in the absence of the flow balancing insert, and an exit aligned to direct the feed gas into a combustor. The swirler also has an annular passage about the central passage and including one or more vanes oriented to impart angular momentum to feed gas exiting the annular passage. The diverging flow generated by the swirler stabilizes lean combustion thus allowing for lower production of pollutants, particularly oxides of nitrogen.

36 Claims, 11 Drawing Sheets

MECHANICAL SWIRLER FOR A LOW-$NO_x$, WEAK-SWIRL BURNER

CROSS REFERENCE TO RELATED APPLICATIONS

This application is a continuation-in-part of U.S. patent application Ser. No. 08/033,878 entitled "ULTRALEAN LOW SWIRL BURNER", filed Mar. 19, 1993, now U.S. Pat. No. 5,735,681, the disclosure of which is incorporated by reference in its entirety herein for all purposes.

This invention was made in the course of or under prime contract number DE-AC03-76SF00098 between the U.S. Department of Energy and the University of California. The government has certain rights in this invention.

FIELD OF THE INVENTION

The present invention relates generally to burners. More specifically, the invention relates to a mechanical swirler for generating diverging flow in lean premixed burners. The diverging flow stabilizes lean premixed combustion thus allowing for lower production of pollutants, particularly oxides of nitrogen.

BACKGROUND OF THE INVENTION

Combustion is a major source of pollutants. One class of pollutants, oxides of nitrogen, or $NO_x$, (NO or nitric oxide, $NO_2$ or nitrogen dioxide, and $N_2O$ or nitrous oxide) contribute to acid rain, smog, global warming, and ozone depletion. As $NO_x$ emissions from combustion sources primarily consist of nitric oxide, an understanding of how NO is generated is important. There are three principal mechanisms which produce NO during combustion: 1) the fuel NO mechanism; 2) prompt NO mechanisms; and 3) the Zeldovich mechanism, also known as "thermal NO". As "fuel NO" is produced via oxidation of nitrogen contained with the fuel, it is not generally an issue for combustion sources using gaseous fuels as these contain little, if any nitrogen compounds. The majority of "prompt NO" is formed through three paths with the significance of each path dependent upon a multiplicity of variables such as pressure, fuel/air ratio, temperature, and concentrations of other compounds. "Thermal NO" is formed by the oxidation of atmospheric nitrogen, $N_2$, and increases exponentially with combustion temperature. In most combustion applications, the majority of NO, and thus $NO_x$ in general, is produced by the "thermal NO" mechanism, with "prompt" and other mechanisms playing a minor role. As such, combustion processes which decrease the combustion temperature, and thus greatly reduce the production of thermal NO, can have a large effect on the entire production of $NO_x$. Further information on this subject may be found in Bowman, C. "Control of Combustion-Generated Nitrogen Oxide Emissions: Technology Driven By Regulation", Twenty-Fourth Symposium (International) on Combustion, The Combustion Institute 1992, pp. 859–878, which is incorporated by reference herein.

The best strategy to control pollution is to minimize its formation at the combustion source. Current research and development efforts are mainly dedicated to lowering emissions through re-engineering of conventional non-premixed combustion systems. Non-premixed combustion is the scientific term given to the combustion process where fuel and oxidizer (usually air) mix and burn concurrently. Non-premixed flames are not clean. Unmitigated, they generally emit unacceptable levels of oxides of nitrogen ($NO_x$) of over 200 parts-per-million (ppm), substantially higher than regulations allow for certain applications. The heating and power generation industries have recognized the need to develop premixed combustion systems as they are much cleaner than non-premixed combustion systems. In premixed combustion systems, as its name implies, gaseous fuel and oxidizer (usually air) are first mixed and then burned. It is desirable to separate the mixing and burning processes, as the user can then control the fuel-to-air ratio being delivered to the reaction zone. The major challenge facing research and development of premixed combustion systems is that the body of knowledge gained from conventional (i.e. non-premixed) burner development is not directly transferable to premixed systems due to differences in flame dynamics.

A burner requires a stable flame. For non-premixed burners, maintaining a stable flame in the zone where the fuel and air are mixing together is the important design criterion. On the other hand, the design of premixed burners have quite different requirements as the mixing occurs separately from the burning processes. Also, when burning the premixed fuel and air mixture (or "feed gas") the flame front propagates through the feed gas. In contrast, non-premixed flames do not propagate. The speed at which a premixed flame propagates through the mixture is called the flame speed. Flame speed is a function of the fuel/air equivalence ratio and turbulence intensities. A fundamental requirement of premixed burners is that the velocity of the premixed feed gas in the burner has to be greater than the flame speed. Otherwise, the flame will propagate upstream against the premixed feed gas stream and into the body of the burner. This condition is termed "flash-back," and must be avoided. To maintain a stable flame, an obstacle may be placed in the premixed feed gas to 'anchor' the flame. The size of the flame anchor (also called a "flame-stabilizer" or "bluff-body") and their aerodynamic shapes can be optimized for given operating ranges and burner considerations. Although these anchors can help to prevent flash-back, a flame can become unstable and "blow-off" the anchor if the velocities are too high. This is particularly true for lean flames, as they tend to blow-off easily due to the excess air in the feed gas. The challenge for premixed burners which support lean flame conditions, is to have a design robust enough to eliminate both flash-back and blow-off occurrences.

Conventionally, stable premixed feed gas flames have been achieved by using a flame anchor, as described above. The obstruction generates a zone of zero axial flow on its upstream side and turbulent flow on its downstream side. As the fuel flows around the obstruction, it becomes turbulent and several regions of reverse flow are created where the fuel flow is actually circling back in a direction opposite to the original flow. This pattern, referred to as "recirculation," is relatively stable and prevents blowout when burner operating conditions are appropriately set.

Swirling flows have also been used to stabilize combustion in a variety of burners, both premixed and non-premixed. Swirl in these burners is generally created either by generating tangential flow motion in a cylindrical chamber, as in cyclone combustion chambers, or swirling a co-axial air flow. In both cases, the function of the swirl is to create a torroidal recirculation zone (TRZ). For non-premixed combustion, the role of the TRZ is to mix the fuel and air to allow for complete combustion, to stabilize the combustion process, to recirculate some fraction of the products, and to dictate the physical shape and length of the flame in these burners. In premixed burners, the TRZ created by the strong swirl creates a zone where the combustion zone is "anchored" due to an area of low flow velocities found within the TRZ.

Many attempts have been made to reduce $NO_x$ emissions from combustion sources in hopes of reducing the air pollution associated with the burning of hydrocarbon fuels. Pollution reduction methods generally fall into two categories. One category of reduction methods involve post-combustion remediation technologies, such as Selective Catalytic Reduction (SCR) or Selective Non-Catalytic Reduction (SNCR), to reduce pollution after it has been generated in the combustion zone. Combustion modifications through burner design changes, such as burning lean, fuel-air staging, or flue gas recirculation, can reduce pollutant formation in the reaction zone. These methods constitute the second category of pollution reduction technologies. Taking into account tradeoffs with engineering considerations and other pollutants, low $NO_x$ burners generally burn with as much excess air (i.e. "lean") as possible, as this will reduce combustion temperatures and minimize thermal $NO_x$ production. Some $NO_x$ may still be produced by virtue of the prompt $NO_x$ mechanisms detailed earlier.

U.S. Pat. No. 4,021,188 to Yamagishi et al. ("the '188 patent") describes various non-premixed burner arrangements using both staged combustion and exhaust gas recirculation to decrease the production of $NO_x$ during combustion of hydrocarbon fuels and air. Staged combustion involves an initial combustion of a fuel rich-air mixture followed by a second combustion zone of the partially combusted fuel exhausted from the first reaction zone, generally in combination with a secondary air supply. The burner configurations disclosed in the '188 patent involve a fuel-rich, first combustion stage followed by a fuel-lean, low-temperature second combustion stage. Several of these configurations involve a swirling mechanism to mix the partially combusted gas discharged from the first combustion stage with a secondary air source. This swirling fuel-air mixture undergoes a second combustion stage at a lower combustion temperature than that of the first stage. The '188 patent discloses a number of apparatuses equipped with a swirling mechanism, such as blades or slits, to induce a rotating flow in the partially combusted gas discharged from the first combustion stage or in the secondary air supply.

In all of these apparatuses, the air component of the fuel-air mixture is supplied to the secondary combustion zone through a separate passage from a separate source from that of the partially combusted gas, which proceeds to the secondary combustion zone through a central passage that is either unobstructed or contains a central hub. The '188 patent also discloses that the partially combusted gas is cooled by a flow which develops as surrounding relatively low temperature combustion gas is attracted into the center of the rotating flow of the partial combustion gas, thereby inhibiting $NO_x$ formation from thermal $NO_x$ production. Thus, these apparatuses rely upon torroidal recirculation for flame stabilization.

For premixed combustion, another design has achieved a significant reduction in $NO_x$ production using single stage combustion without recirculation. U.S. patent application Ser. No. 08/033,878, filed Mar. 19, 1993 ("the '878 application), which is the parent of the present application, and has been previously incorporated by reference into the present application, discloses a lean premixed burner which generates a stable flame by swirling the edges of a thoroughly mixed fuel-air mixture without inducing recirculation. Unlike many conventional burners, including the second stage of the burners disclosed in the '188 patent, in which the fuel and air are mixed in the combustion zone, the '878 application discloses a premixed fuel-air mixture that is swirled gently by low swirl jets of air, or premixed fuel/air, introduced tangentially to the premixed stream of feed gas upstream of the reaction zone. The low swirl creates a divergent flow pattern that "anchors" the flame at the point where the flame speed balances the mass flow rate of the fuel-air mixture, thus stabilizing the flame zone without the use of recirculation.

A common parameter for characterizing the swirl intensity of swirl burners is in use throughout the combustion industry. The non-dimensional swirl number, S, is defined as the ratio of axial flux of angular momentum to the axial flux of linear momentum divided by the nozzle radius:

$$S = \int_0^R Uwr^2dr/R\int_0^R U^2rdr \tag{1}$$

where R is the nozzle radius, and U and W are the mean axial and tangential components of the flow velocity within the swirl generator, respectively.

For a tangential air injection swirler, this integral form is commonly approximated by the following geometric form:

$$S_g = \frac{\pi r_\theta R}{A_\theta}\ (m_\theta/(m_\theta + m_a))^2 \tag{2A}$$

where $r_\theta$ is the radius of the swirl jets, $A_\theta$ is the total area of the jets, $m_\theta$ is the total tangential mass flow, and $m_a$ is the total axial mass flow.

For a conventional hub vane-swirler design without flow through the central hub, the swirl number equation (1) reduces to:

$$S = \frac{2}{3}\ U^2\tan\alpha(R^3 - R_h^3)/RU^2(R^2 - R_h^2) \Rightarrow \frac{2}{3}\ \tan\alpha\frac{1-(R_h/R)^3}{1-(R_h/R)^2} \tag{2B}$$

where $R_h$ is the radius of the central hub, $\alpha$ is the vane angle from the vertical axis, and U is uniform over the tube cross section. The conventional hub vane-swirler was designed for non-premixed combustion in which the central hub acts as a bluff-body and generates a torroidal recirculation zone. TRZs are formed only when there is a high degree of swirl in the flow field, that is, where $S \geqq$ approximately 0.6.

The swirl requirement of a weak-swirl burner (WSB) is different from that of other burners since the feed gas is premixed and flame stabilization is achieved through use of a divergent flow field instead of a TRZ. Due to the propagating nature of pre-mixed flames and the deceleration of the flow as it moves away from its source, the flame is able to dynamically stabilize itself at the position where the local mass flow rate balances the flame propagation speed. The weak-swirl stabilization mechanism does not apply to diffusion flames (not pre-mixed) because they do not propagate, but rather burn at the boundary where the air and fuel flows have diffused to the appropriate ratios for sustaining the combustion reaction.

The air-swirled weak-swirl burners disclosed in the '878 application are well suited for those applications where compressed air is readily available and currently used, such as in boilers and industrial furnaces. However, air injection may be impractical or uneconomical (due the necessary compressor and controls) for some high volume, low margin consumer products, for example, water heaters. Therefore, it would be highly desirable to replicate the benefits of the low $NO_x$ emission weak swirl burner of the '878 application with alternative designs, particularly if those designs were easily adaptable to a broad range of applications and were relatively simple and economical to scale, manufacture and operate.

Accordingly, there is a need for alternative designs for weak-swirl burners.

SUMMARY OF THE INVENTION

The present invention provides a mechanical swirler useful for the combustion of a thoroughly premixed fuel/air stream without the use of a stabilizing recirculation zone. The mechanical swirler of the present invention may be used to induce angular momentum into a feed gas stream. As with the air-swirler, the mechanical swirler creates a stable flow pattern that anchors the flame at the point where the flame speed balances the mass flow rate of the fuel-air mixture, without the use of a stabilizing recirculation zone. The invention also provides several burner designs which incorporate the mechanical swirler.

More particularly, the invention provides a mechanical swirler having a central passage with an inlet to accept a combustion feed gas, a flow balancing insert that introduces additional pressure drop beyond that occurring in the central passage in the absence of the flow balancing insert, and an exit aligned to direct the feed gas into a combustor. The swirler also has an annular passage about the central passage and including one or more vanes oriented to impart angular momentum to the feed gas exiting the annular passage.

The invention also provides a combustor having a mixer for premixing fuel and oxidant to produce a feed gas and a swirler located downstream from the mixer and capable of receiving a premixed feed gas from the mixer. The swirler has a central passage having an inlet for accepting a portion of the feed gas, a flow balancing insert that introduces additional pressure drop beyond that occurring in the central passage without the flow restriction insert, and an exit aligned to direct that portion of the feed gas into a combustion zone. The swirler also has an annular passage about the central passage with an entrance for accepting another portion of the feed gas, one or more vanes oriented to impart angular momentum to feed gas exiting the annular passage and an exit aligned to direct the other portion of the feed gas into the combustion zone, which is capable of supporting combustion of the premixed feed gas.

The invention additionally provides a method of combustion which involves mixing a fuel and an oxidant into a feed gas, weakly swirling the said feed gas in a swirler in accordance with the present invention, and combusting said weakly swirled feed gas.

Further, the invention provides a variety of apparatuses incorporating mechanical swirlers in accordance with the present invention.

Mechanical swirlers according to the present invention are easily adaptable to a broad range of applications and are relatively simple and economical to scale, manufacture and operate. These and other advantages of the present invention will become apparent to those skilled in the art with a review of the detailed description of the preferred embodiments and the drawings.

DETAILED DESCRIPTION OF THE PREFERRED EMBODIMENTS

Generally, the present invention provides an improved swirler for the combustion of premixed feed gas without a stabilizing recirculation zone. A preferred application of the mechanical vane-swirler of the present invention is in low $NO_x$-generating weak-swirl burners (WSBs). In the following description, numerous specific details are set forth in order to provide a thorough understanding of the present invention. It will be apparent, however, that the present invention may be practiced without limitation to some of the specific details presented herein.

The present invention will be described in terms of several preferred embodiments. However, these embodiments do not limit the spirit or scope of the invention which are defined by appended claims.

Figure 1:
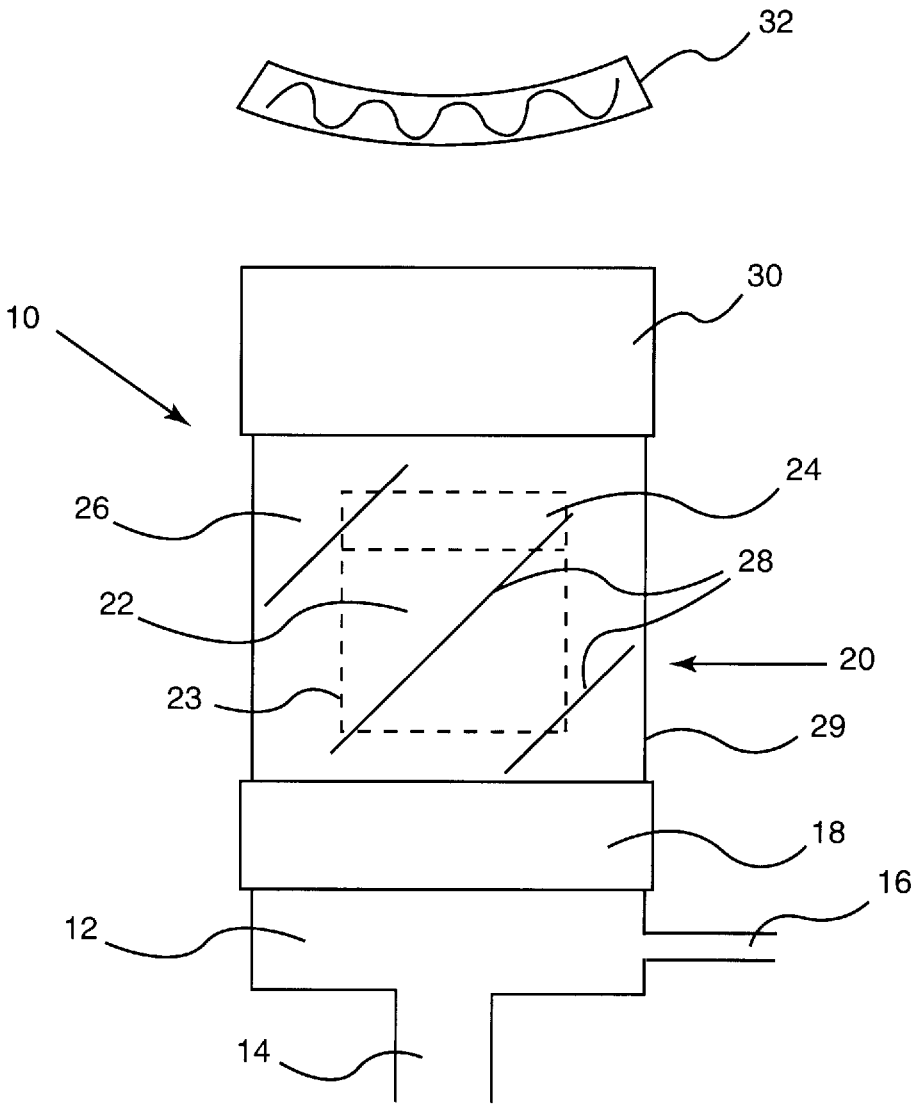
FIG. 1 is a side cross-sectional view of a combustor according to a preferred embodiment of the present invention.

FIG. 1 shows a combustor 10 in accordance with a preferred embodiment of the present invention. A fuel, such as natural gas, propane, or a prevaporized liquid hydrocarbon, or mixture of fuels enters the mixing chamber 12 through conduit 16. A fluid oxidant such as air, enters the mixing chamber 12 through conduit 14. The fuel and air mixture is thoroughly mixed before proceeding into entrance tube 18. From entrance tube 18, the pre-mixed fuel-air mixture flows into the combustion feed-gas swirler 20 of the present invention. The swirler includes a central passage 22 containing a flow balancing insert 24. The central passage 22 is surrounded by an annular passage 26. The annular passage 26 includes a series of vanes 28 orientated to impart an angular momentum to feed-gas exiting the annular passage 26. From the swirler 20, the feed-gas flows into an exit tube where the feed-gas swirl is allowed to fully develop before entering the flame zone 32 immediately above but not, usually, in contact with the exit tube 30.

Figure 2A:
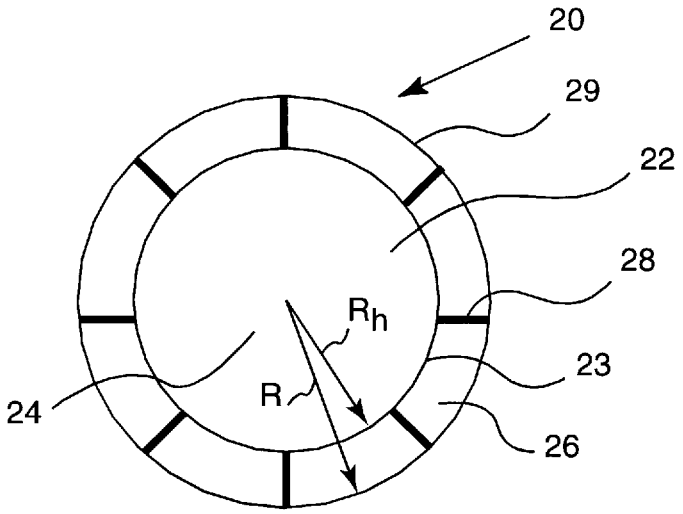
FIG. 2A is a top cross-sectional view of a swirler according to a preferred embodiment of the present invention.

FIG. 2A shows a transverse cross-section of the swirler portion of the preferred embodiment of the present invention as illustrated in FIG. 1. As mentioned, the swirler is composed of a central passage 22 surrounded by an annular passage 26. The central passage 22 contains a flow balancing insert 24, generally made from a metal mesh, perforated screen, or other porous material. The annulus 26 is defined by an outer tube 29 and an inner tube 23. Within the annulus 26, are one or more vanes 28, which may, but need not overlap, and may, but need not extend from the inner tube 23 to contact the outer tube 29. In FIG. 2A, R represents the outer radius of the annulus; $R_h$ represents the inner radius of the annulus; n represents the number of vanes.

Figure 2B:
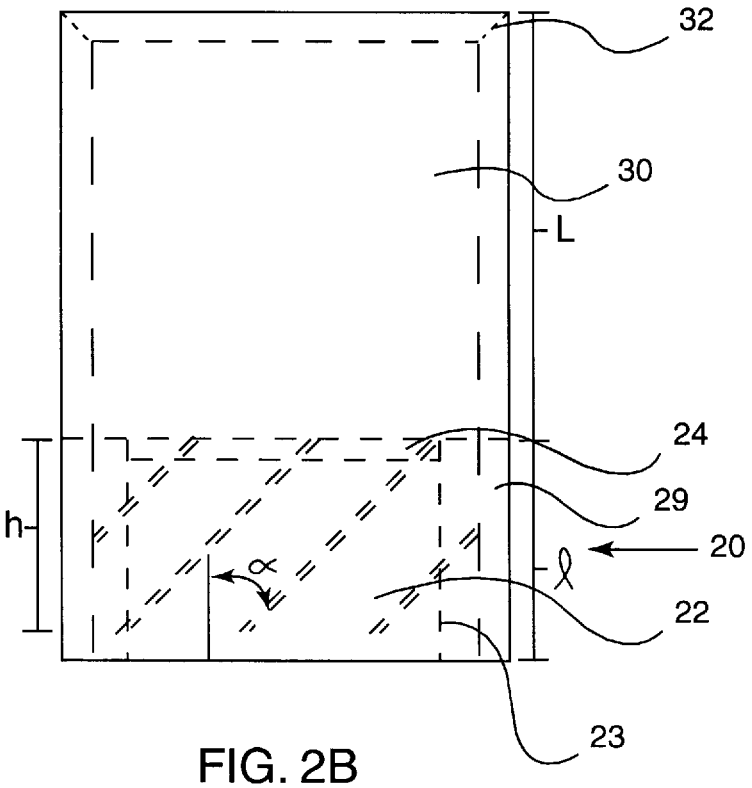
FIG. 2B is a side cross-sectional view of a swirler according to a preferred embodiment of the present invention.

FIG. 2B shows an axial cross section of the swirler 20 and exit tube 30 portions of the preferred embodiment of the present invention illustrated in FIG. 1. In addition to $R_h$, R and n, other parameters characterizing the swirler 20 may be defined as follows: l represents the length of the inner tube 23 which forms the central passage 22; $\alpha$ represents the swirl vane angle (pitch) measured from the vertical; and h represents the swirl vane height. The swirl vanes may be fixed or movable, and the swirl vane pitch may be fixed or adjustable.

Figure 2C:
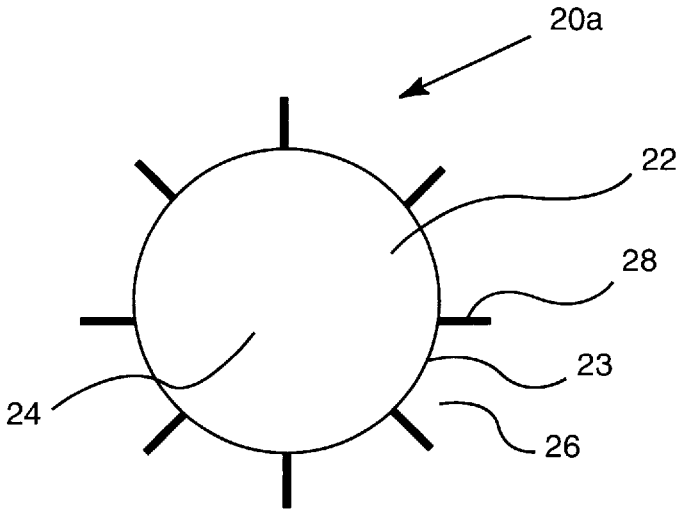
FIG. 2C is a top cross-sectional view of a swirler according to a preferred embodiment of the present invention where the swirler is designed as an insert into a separate outer tube.
Figure 2D:
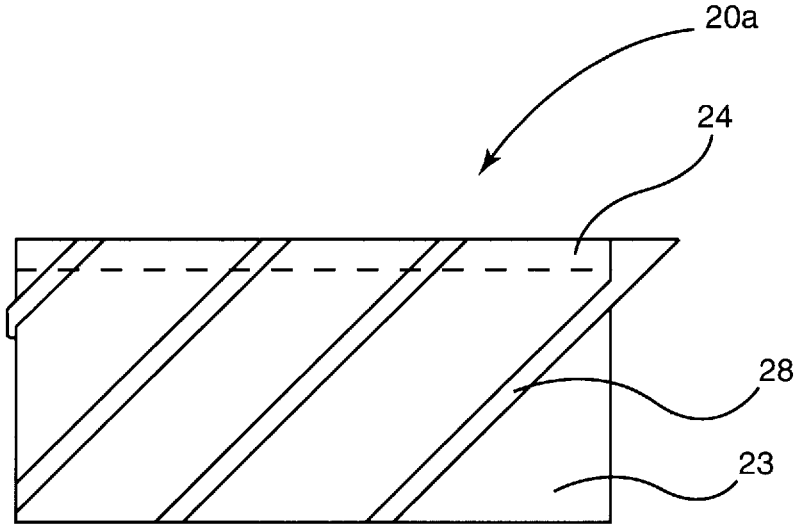
FIG. 2D is a side cross-sectional view of a swirler according to a preferred embodiment of the present invention where the swirler is designed as an insert into a separate outer tube.

FIGS. 2C and 2D show an alternate version of the swirler 20*a* where the swirler is a separate insert without the outer tube 29 shown in FIGS. 2A and 2B, so that the annular passage has no outer boundary. In this version, the swirler 20*a* would be placed within a separate outer tube (not shown). In all other respects this swirler is identical to that described in FIGS. 2A and 2B.

The exit tube 30, which is optional, but preferred, generally has approximately the same diameter as that of the swirler 20. The exit tube is further defined by L which represents its length. The rim of the exit tube may be square, but in a preferred embodiment will be tapered.

While, in principle, there are no limitations on the size of the swirler of the present invention, generally, the parameters characterizing the swirler 20 may be set within the following ranges: $R_h$ may be between about 4 and about 400 millimeters; R may be between about 5 and about 500 millimeters; l may be between about 5 and about 500 millimeters; n may be from 1 to about 50; $\alpha$ may be from about 15 to about 75 degrees; h may be between about 5 and about 500 millimeters; the flow balancing insert 24 may be constructed from metal, plastic or other rigid material within which holes are placed, in either staggered rows or a square pattern, to allow for the passage for the premixed feed gas, the total closed area of the holes ranging from about 80% to 40% of the total area of the insert; metal or plastic mesh, screens, or wire cloth with the closed area ranging from about 85% to 50%; metal, plastic, or ceramic porous material which allows for the passage of feed gas ranging over a variety of porosity and density parameters; and an exit tube 30, if present, may have L from between about 5 and about 500 millimeters and a square or tapered rim from about 15 to about 75 degrees.

In a specific embodiment, these parameters are set as follows: $R_h$ is approximately 20 millimeters, R is approximately 26 millimeters, l is approximately 35 millimeters, n is 8; $\alpha$ is 37 degrees; h is approximately 35 millimeters; the bottom of each vane vanes slightly overlaps the top of the adjacent vane and extend from the outer tube 29 to the inner tube 23; and the flow balancing insert 24 is a perforated metal screen with a hole radius of approximately 3 millimeters in a square pattern having a total closed area of approximately 70%. In this particularly preferred embodiment, an exit tube 30 having L equal to 62 millimeters and a 45° tapered rim is used.

Burners in accordance with the present invention will produce a stable flame without recirculation as the stabilization mechanism. The burners use a premixed fuel-air feed gas which may be composed of any type of hydrocarbon fuel and any oxygen-containing gas. Particularly preferred fuel-air mixtures are natural gas combined with air or propane combined with air. Also, burners in accordance with the present invention may function over a wide variety of pressures from sub-atmospheric as high as 40 to 50 atmospheres.

The swirler of the present invention produces the necessary diverging flow field to stabilize a lean pre-mixed flame above the exit of a burner tube. An important feature of the present invention is the flow balancing insert of the central passage which distributes the fuel-air mixture flow between the central passage and the annulus so that the portion of the fuel-air mixture in the central passage is not affected by the swirl vanes in the annulus. The annular, swirled flow generates the necessary flow divergence for stabilization by the weak swirl burners of the present invention. Distributing the fuel-air mixture between the two portions of the swirler may be achieved through a myriad of different combinations of the values of the parameters which define the swirler, and optionally the exit tube. Any variation or combination of these parameters which produces a stable flame without recirculation as the means of stabilization meets the requirements of the present invention. This design differs from conventional vane-swirlers that emphasize the generation of recirculation zones. Further, the vane-swirler of the present invention simplifies the design of weak-swirl burners since it does not require separate flow supplies and controls necessary when using tangential injection to generate the swirl needed to stabilize the combustion zone.

Burners according to the present invention have been shown to support stable combustion from 40,000 to 500,000 Btu/hour of input power. The burner design is freely scaleable for any potential power requirement or application. In addition, the swirler of the present invention may be combined with other $NO_x$ mitigation techniques including, but not limited to, selective catalytic and non-catalytic reduction technologies.

The burner may be constructed of standard materials used in the art, or any other suitable material including stainless steel and aluminum, other metals and alloys, ceramics, and polymeric materials. Generally, the materials from which the swirler device are constructed are not necessarily limited to materials which can withstand intense combustion heat, as the swirler of the present invention may be operated to generate a flame which usually does not contact any components of the swirler device, while the flow through the burner provides a cooling effect to the materials which receive radiative heat from the flame.

An important difference between the vane-swirler of the present invention and conventional hub-swirlers is that the design of the present invention allows for a center core of pre-mixture which has no tangential velocity. Without a flow balancing insert to distribute the flow to the annulus, most of the flow in this design would be forced through the center core due to the higher pressure drop associated with the swirl-vanes in the annular section. The use of flow balancing inserts with different blockages to distribute the pressure across the center and annular regions enables the swirl rate to be varied.

Figure 3:
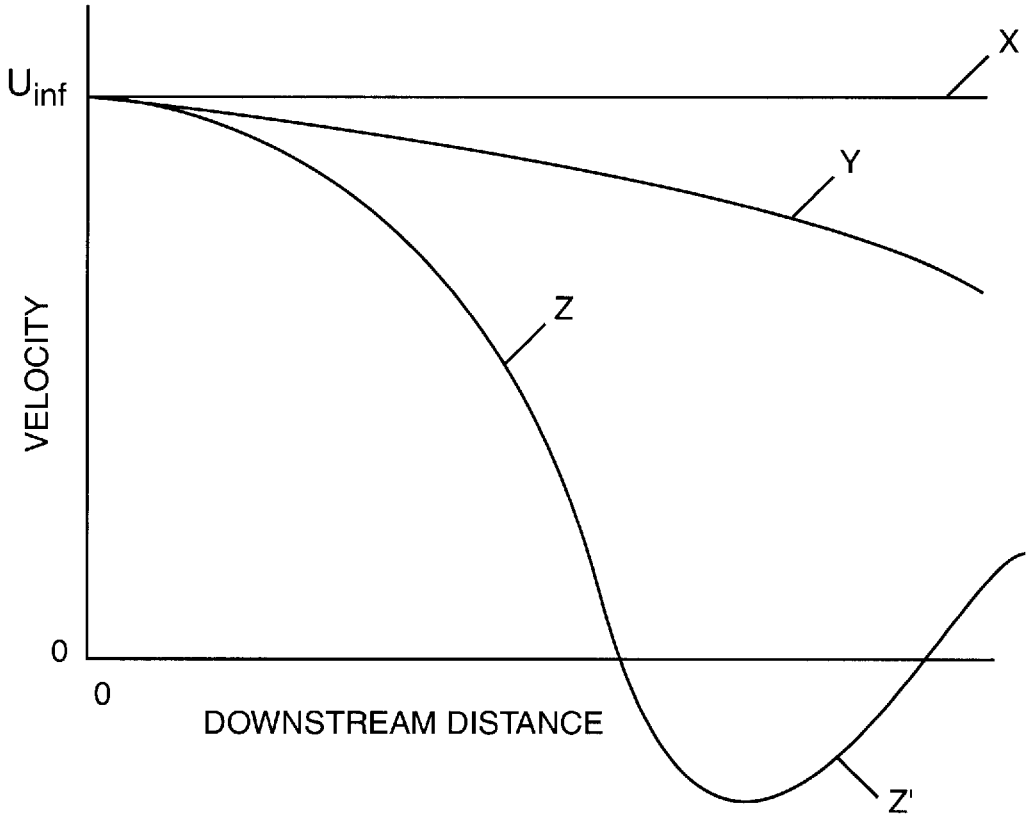
FIG. 3 is a velocity vs. distance graph of swirl regimes.

FIG. 3 is a graph of premixed feed gas flow velocity (initially higher than the mixture's flame speed) vs. downstream distance showing the various swirl regimes. The flat profile of line X represents the situation where the flow velocity does not decrease, or decreases very slowly, such as in a simple axial flow. As there is no swirl to reduce the flow velocity, this is unstable and the flame will blow-off. The gradual sloping profile of curve Y represents the premixed feed gas axial velocity profile generated by the weak swirl provided by the mechanical swirler of the present invention. With the weak swirl, the flame will stabilize at the location where the fuel mixture flow rate is equal to the flame propagation speed. Recirculation as a means of stabilization is not present in this situation. Finally, curve Z represents the strong swirl situation, such as a hub swirler, where the induced angular momentum is so strong that recirculation, evidenced by the negative velocity portion (Z') of curve Z, results.

It is believed that the improved performance of the device of the present invention relative to previous burners may be explained and described by the following swirl number equation:

$$S_v = \frac{2}{3}\tan\alpha\,\frac{1-(R_h/R)^3}{1+(R_h/R)^2\left((U_c/U_a)^2-1\right)} \tag{3}$$

where $S_v$ is the swirl number for a vane swirler, $U_c$ is the mean axial core velocity, and $U_a$ is the mean axial velocity component in the outer annulus. An assumption is that the mean axial velocity is uniform entering the core and entering the annulus. However, $U_c$ and $U_a$ are not necessarily identical as they are affected by the flow balancing insert blockage in the central passage and the vanes in the annulus, respectively.

Figure 4:
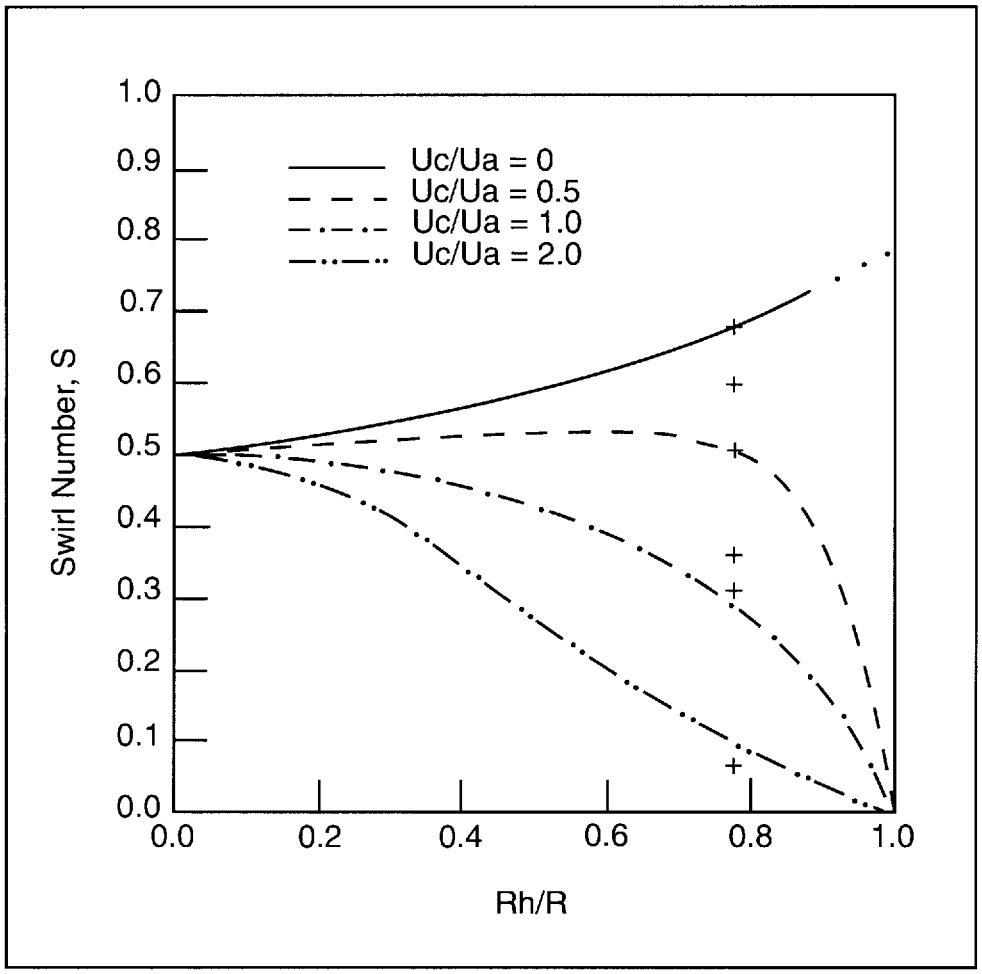
FIG. 4 is a graph of swirl number vs. the ratio of central passage radius to total swirler radius ($R_h/R$) for various ratios of core velocity to annular velocity ($U_c U_a$).

FIG. 4 shows the general functional dependence of $S_v$ on the two important parameters, $U_c/U_a$ and $R_h/R$, with specific data as indicated by a cross (+) from a vane-swirler with $\alpha$ equal to the 37 degrees. As $S_v$ scales by tan $\alpha$, the general shapes of these curves remain the same for different values of $\alpha$. When $R_h$ is approximately equal to R (i.e., the annulus is absent), $S_v$ reduces to zero and when $U_c$ equals zero, as in the case of a solid hub, $S_v$ is identical to the value of S obtained for the hub swirler with equation (2B). FIG. 3 also shows that varying $R_h/R$ of the hub swirler (solid line) from 0 to 0.9 only changes $S_v$ by approximately 50%.

For a device in accordance with the present invention, which allows a core flow through a central passage, $S_v$ can be conveniently varied by changing $U_c/U_a$ or $R_h/R$. For example, by increasing the closed area of the flow balancing insert in the central passage, $S_v$ increases due to the higher pressure drop through the central passage which forces more flow through the annular region. Distributing the flow between the two regions, central and annulus, may be varied by placing different flow balancing inserts in the central passage. Once the regime of $S_v$ for flame stabilization without recirculation has been established for different velocities and equivalence ratios, the graph in FIG. 4 may be useful as a design tool for scaling the burner to different power ratings and physical dimensions.

Generally, combustors according to the present invention will generate weak swirl characterized by a vane swirl number ($S_v$) between about 0.25 and about 0.60; preferably between about 0.27 and about 0.58; and more preferably between about 0.35 and 0.55. In a specific embodiment of the present invention, the weak swirl is characterized by a vane swirl number of about 0.48.

Further description of the properties and characteristics of swirlers and burners in accordance with the present invention is provided by the following examples. The examples are intended to illustrate various aspects of preferred embodiments of the present invention, but not to limit its scope.

EXAMPLE 1

Flow Field Measurement for a Variety of Flow Balancing Inserts

One feature of the present invention is the ability to interchange a variety of flow balancing inserts having different amounts of blockage, in order to correctly proportion the core (central) and swirl (annular) flows to achieve flame stabilization without recirculation. Table 1 provides details of four (4) screens used as flow balancing inserts.

TABLE 1

| Screen | Blockage | Hole diameter | Hole to hole distance, s | Spacing of holes |
|---|---|---|---|---|
| 1 | 75% | 2.9 mm | 5.1 mm (square) | 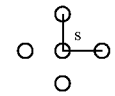 |
| 2 | 70% | 3.2 mm | 5.1 mm (square) | |
| 3 | 65% | 3.2 mm | 4.8 mm (square) | |
| 4 | 60% | 3.2 mm | 4.8 mm (hexagon) | 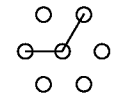 |

In order to test the flow field generated by the vane swirlers of the present invention, velocity measurements were obtained by a two-component Laser Doppler Anemometry (LDA) system. This system uses a two-color, four beam, four (4) Watt argon ion laser (Spectra Physics model 164) separated into four (4) intersecting beams. Differential frequencies of 5 MHz and 2 MHz as generated by Bragg cells were used to remove directional ambiguity for the axial and tangential components, respectively. Velocity profiles were taken at 5 millimeters above the swirler (no exit tube). The vane swirler used for this experiment had the parameters of the particularly preferred embodiment noted above. Therefore, the vane angle, $\alpha$, equaled 37 degrees and $R_h/R$ equaled 0.776. Experimental test conditions for this vane swirler are noted on FIG. 4 by a cross (+). The test conditions included the four (4) screens of Table 1, an open central passage (no screen) and, a completely closed central passage (i.e. a hub). From the LDA velocity measurements, $U_c$ was analyzed from r=−20.5 to r=+20.5 millimeters with r=0 at the center of the swirler. $U_{inf}$ is the mean flow velocity deduced from the total flow rate as measured by the turbine flow meter. Finally, $U_a$ was then calculated from the total mass flow rate as $U_a=(U_{inf}*R^2-U_c*R_h^2)/(R^2-R_h^2)$. From these velocities, the swirl number $S_v$ is calculated and plotted on FIG. 4 as the experimental data points.

Figure 5:
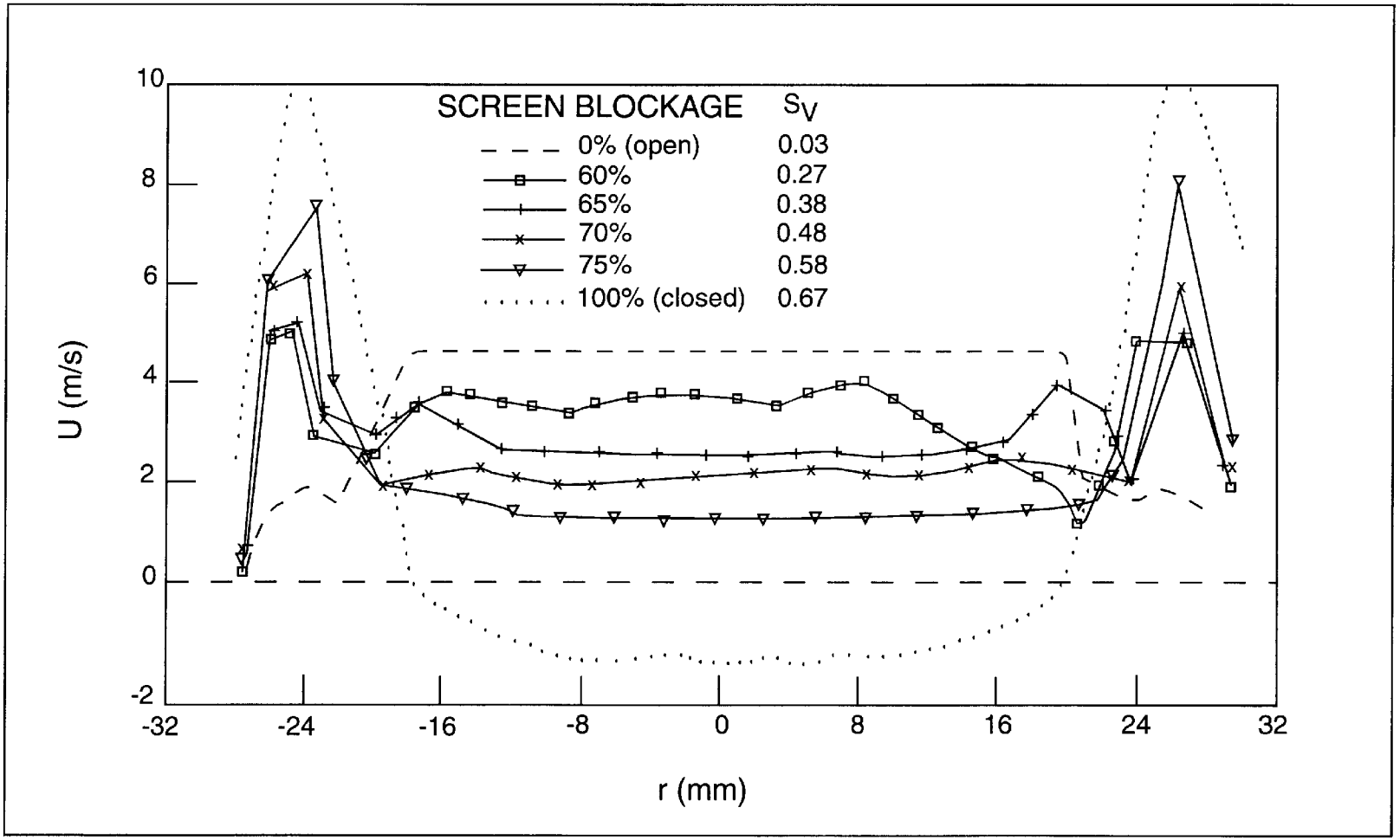
FIG. 5 is a graph of axial velocity vs. radius showing actual axial velocity flow profiles and swirl numbers for a variety of different swirlers.

FIG. 5 shows the axial velocity profiles of the six (6) conditions tested. With $U_{inf}$ held constant at 3.0 m/s, the results indicate swirl numbers ranging from $0.27<S_v<0.58$ for the screens, $S_v=0.03$ for the open case, and $S_v=0.67$ for the hub case. These U profiles are characterized by a uniform core flow region from −16 mm<r<16 mm, surrounded by the swirled region where the flow velocity can be higher or lower than the core region depending on the amount of center blockage caused by the flow balancing insert. As expected, when there was no screen in the central passage, the flow restriction in the annular region forces the bulk of the flow to accelerate through the inner tube, resulting in $U_c$ much greater than $U_{inf}$. At the other extreme, with complete blockage of the central passage, $U_c$ is negative and $S_v$ is calculated as 0.67, indicating that a recirculation zone has been generated downstream of the bluff body hub. This is an accord with the theory which states that recirculation occurs when S is greater than or equal 0.6. For a 60% blockage, acceleration beyond $U_{inf}$ still occurs as $U_c$ is higher than $U_{inf}$=3.0 m/s. Further increases in blockage force more flow into the annulus such that $U_c<U_{inf}$. With the blockage of 70%, $U_c/U_a$ reduces to 0.5 and the calculated $S_v$=0.48. Increasing the blockage further, to 75%, creates a situation where recirculation is imminent ($S_v$ 0.57). These results suggest that flow balancing inserts of above 60% but less than 75% would be most appropriate for use in a weak-swirl burner.

EXAMPLE II

Weak Swirl Vane-Swirler Performance

Figure 6:
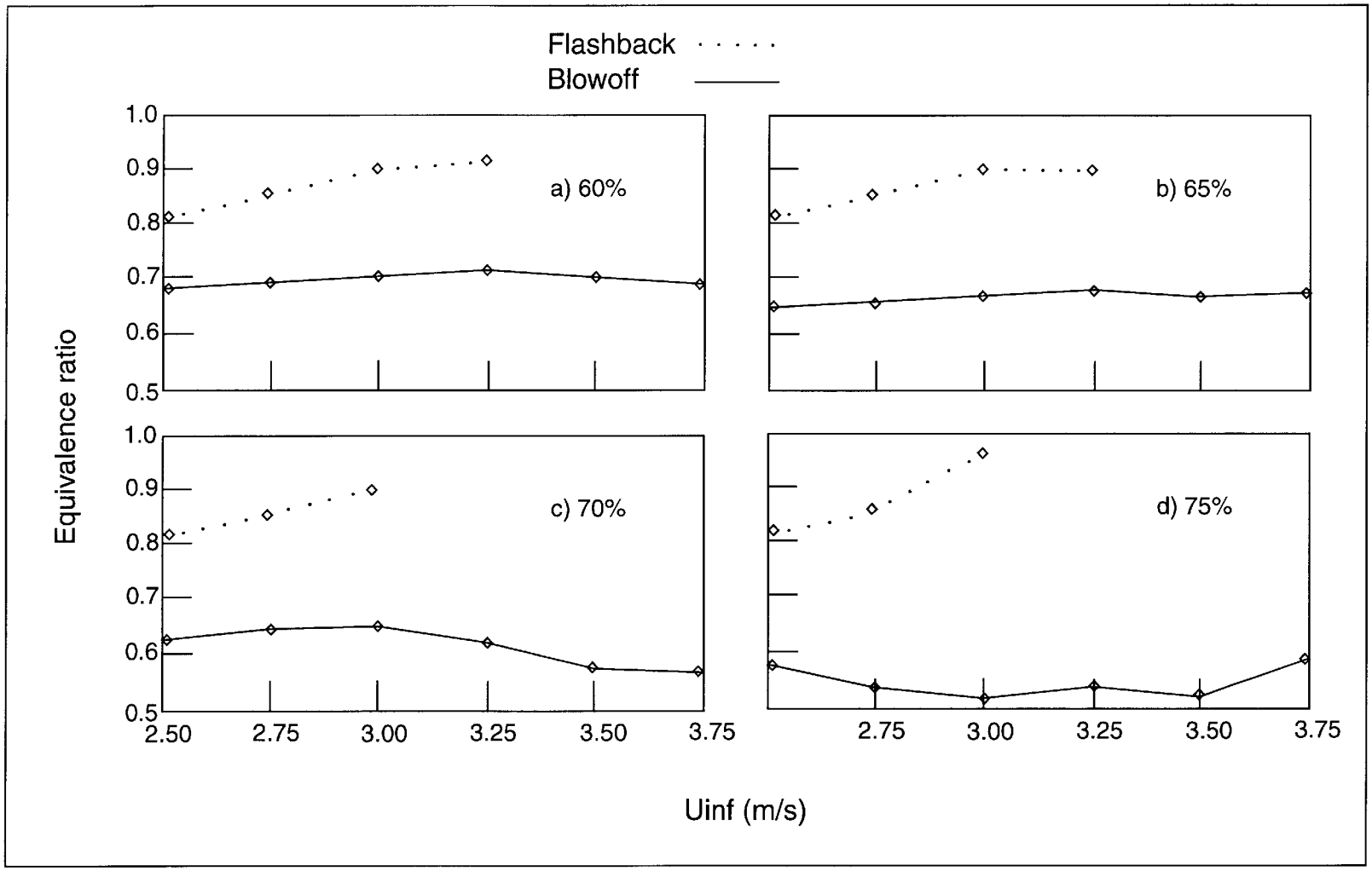
FIG. 6 is a set (a–d) of graphs of equivalence ratio vs. mean flow velocity ($U_{inf}$) showing stabilization limits for various flow balancing inserts in a vane-swirler in accordance with a preferred embodiment of the present invention.

Performance of a weak-swirl burner was evaluated by determining the flame stabilization limits of burners with an exit tube length (L) approximately equal to 7 centimeters, fitted with a 37° (α) vane swirler and a variety of different flow balancing inserts. Two (2) turbine meters were used to measure the separate natural gas and combustion air flow rates, and the WSB was operated open to the atmosphere. From this data, both firing rate (firing rate is the input power to the burner which corresponds to the mass flow of the fuel only (i.e. air flow doesn't contribute to power)) and equivalence ratios (ratio of actual fuel to actual oxygen divided by the ratio of stoichiometric fuel to stoichiometric oxygen) were determined. For these test cases, the WSB was operated open to the atmosphere with no surrounding enclosure. FIG. 6 shows the stable operating range for the four (4) different balancing flow inserts; 60%, 65%, 70% and 75% blockages. To obtain the conditions at blow-off and flash-back, $U_{inf}$ was held constant while the equivalence ratio was varied.

This resulted in the upper dotted lines which represent the flash-back limit for each flow balancing insert, and the lower solid line which denotes the blow-off limit. The region between the two limits is where stable operation was found.

For each of the four (4) flow balancing inserts, the blow-off limits were found to be rather independent of $U_{inf}$. There was a general lowering of equivalence ratio at blow-off with increasing blockage. At blockage of 60% (a), blow-off occurs at equivalence ratio equal to approximately 0.70, while it lowers to equivalence ratio equal to about 0.55 for a flow balancing insert blockage of 75% (d). As expected, flash-back limits increased with increasing $U_{inf}$ as the flow velocity becomes significantly higher than the flame speed. For all cases, the data trend indicated that the flash-back limit would be beyond an equivalence ratio equal to 1.0 around $U_{inf}$ equal to approximately 3.5 to 3.75 m/s. As the maximum natural gas/air flame speed occurs at an equivalence ratio of approximately 1.0, these results suggest that the flash-back phenomenon should not be a problem for operating conditions with $U_{inf}$ values greater than about 4.0 m/s.

The vane swirler can thus offer a wide operating range from stoichiometric throughout the lean regime and down to the blow-off limit. Even though changes in the flow balancing insert or combustion chamber can have effects on stabilization limits, flame geometry, and power density, the WSB has been found to produce $NO_x$ emissions well below current regulations.

EXAMPLE III

NO Emissions

Since $NO_x$ generation is strongly dependent on temperature, lean flames are desirable as they have lower flame temperatures than the partially pre-mixed or diffusion flames generated by many conventional burners. In evaluate the performance of the vane swirler of the present invention in a practical situation, a laboratory test station that simulates the operation of a 50,000 Btu/hour spa heater (Teledyne Laars, model Telstar) was used. In this test station, a WSB using the mechanical swirler described earlier in the specific embodiment replaced the standard rack burner used in the Telstar heater. Emission samples were extracted in the flue of the heater, and analyzed by a chemiluminescent Thermo-Electron NO—$NO_x$—$NO_2$ analyzer using standard laboratory practices. Thermal efficiencies were calculated with the use of two high-precision (±0.1° C.) thermometers to measure the inlet and outlet water temperatures, while water flow rates were calculated from a flow totalizer. Air and fuel flow rates were measured as described earlier.

Figure 7:
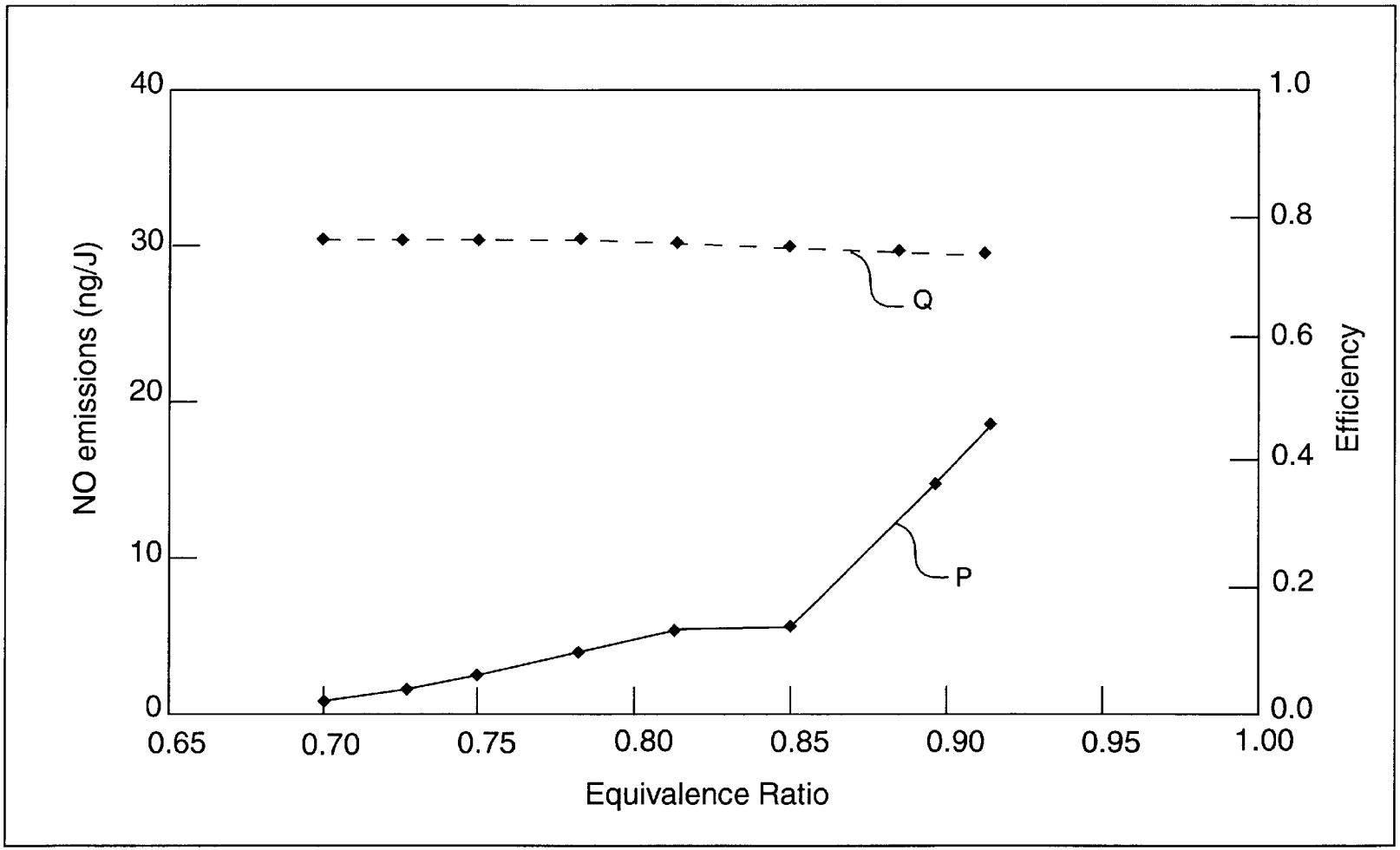
FIG. 7 is a combined graph of NO emissions and efficiency vs. equivalence ratio for a preferred embodiment of the combustor of the present invention.

FIG. 7 shows NO emissions (solid line P) as well as thermal efficiency broken line Q) of the heat exchanger, for the vane-swirled weak-swirl burner of the present invention. In the graph of FIG. 7, NO readings are in ng/J, in accordance with regulations governing $NO_x$ emissions. As the graph demonstrates, $NO_x$ emissions range from 1 ng/J at equivalence ratio equal to 0.70 to about 17.5 ng/J at an equivalence ratio equal to about 0.95. A conventional partially pre-mixed burner operating under similar conditions, produced approximately 70 ng/J of $NO_x$, an order of magnitude higher than the WSB emissions.

Figure 8:
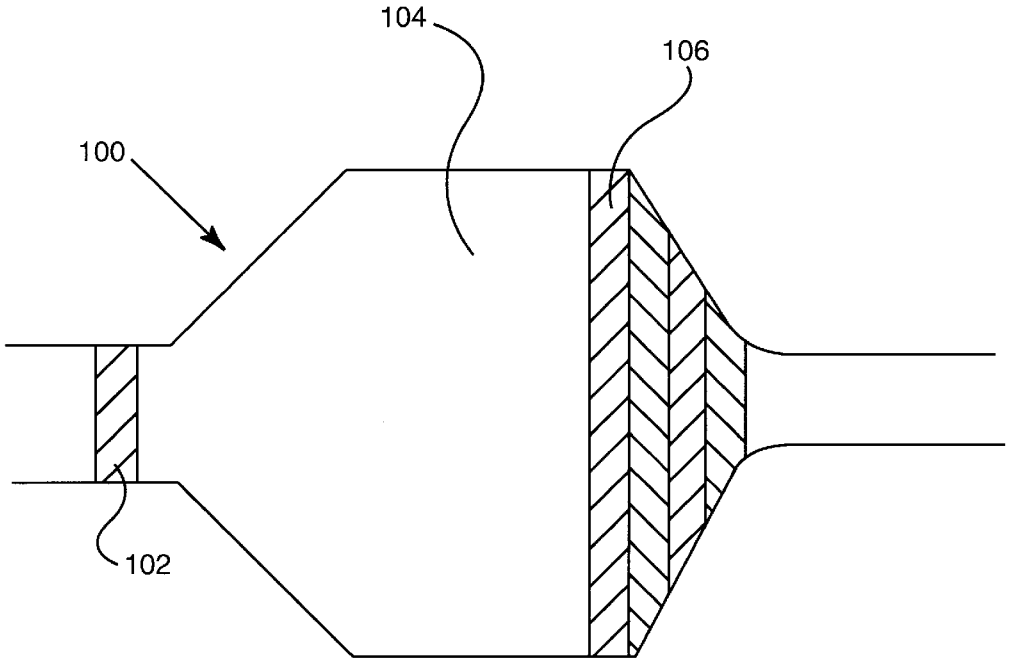
FIG. 8 is a cross-sectional depiction of a turbine embodiment of the present invention.

The swirler and burner of the present invention have several possible alternative embodiments. For example, in FIG. 8, a swirler 102 in accordance with the present invention is shown in a turbine embodiment 100. The pre-mixed fuel-air mixture is compressed downstream of the swirler and then enters the turbine burner's combustion zone 104 through the swirler 102. Following combustion, the combustion products are exhausted through a turbine(s) 106 which rotates to generate electricity.

Figure 9:
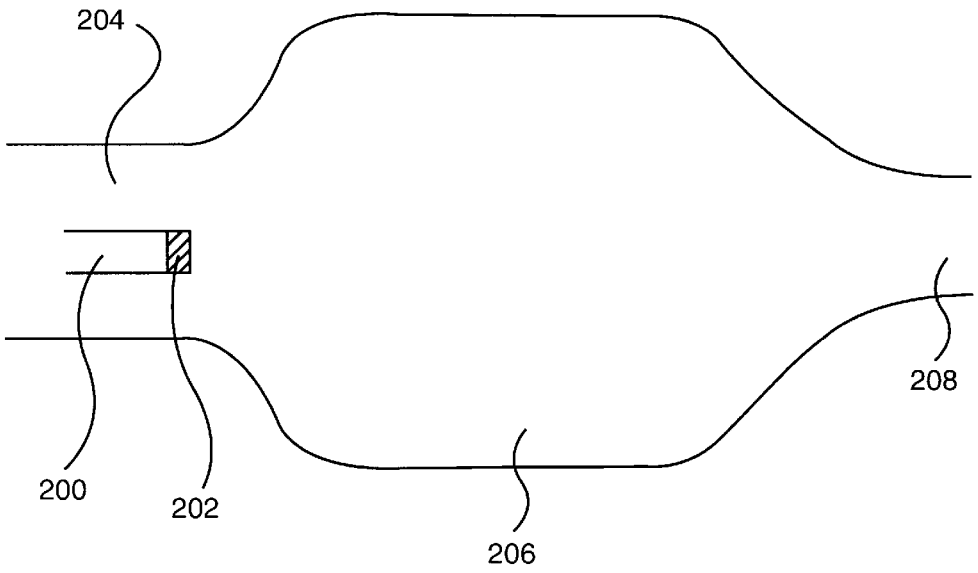
FIG. 9 is a cross-sectional depiction of a combustor according to the present invention operating as a pilot.

In another alternative embodiment, the swirler of the present invention may be used as a pilot for a larger burner. This particular embodiment has substantial advantages for reducing $NO_x$ emissions since conventional pilots are generally very rich burning diffusion flames which generate large amounts of $NO_x$. By replacing a conventional pilot burner with a weak swirl burner in accordance with the present invention, a stable lean pilot flame may be maintained without production of large amounts of $NO_x$. As shown in FIG. 9, the premixed feed gas enters through conduit 200. A weak-swirl burner 202 such as that illustrated in FIG. 1, is mounted in conduit 200 and operates as a pilot. An outer annulus 204 surrounds the weak-swirl burner pilot 202. When the main flame is to be ignited, a fuel source is supplied to outer annular conduit 204. Once the fuel in outer conduit 204 reaches the flame of weak swirl pilot burner 202, it is ignited and combusted in combustion chamber 206. The main burner combustion products are exhausted through conduit 208.

Figure 10A:
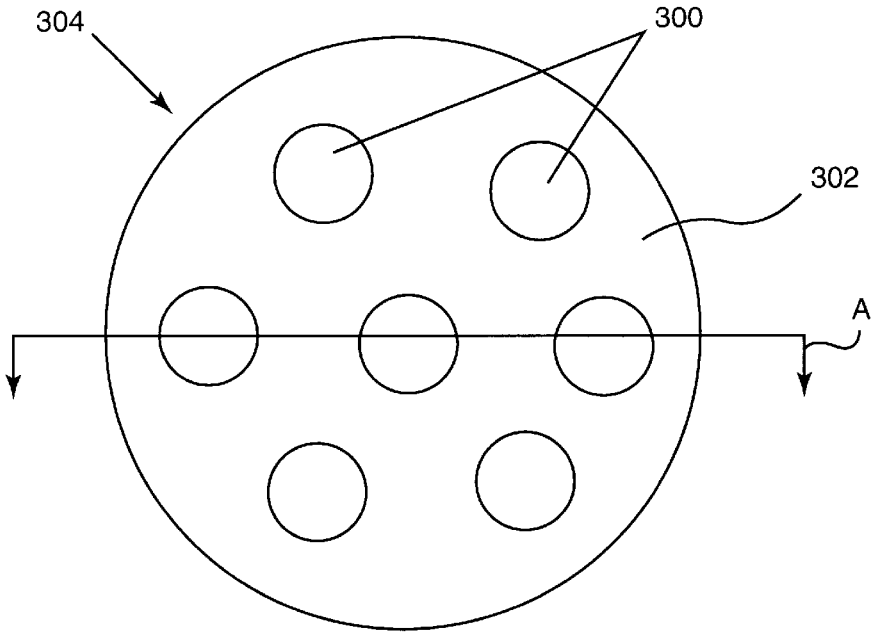
FIG. 10A is a top cross-sectional view of a multi-swirler embodiment of the present invention.
Figure 10B:
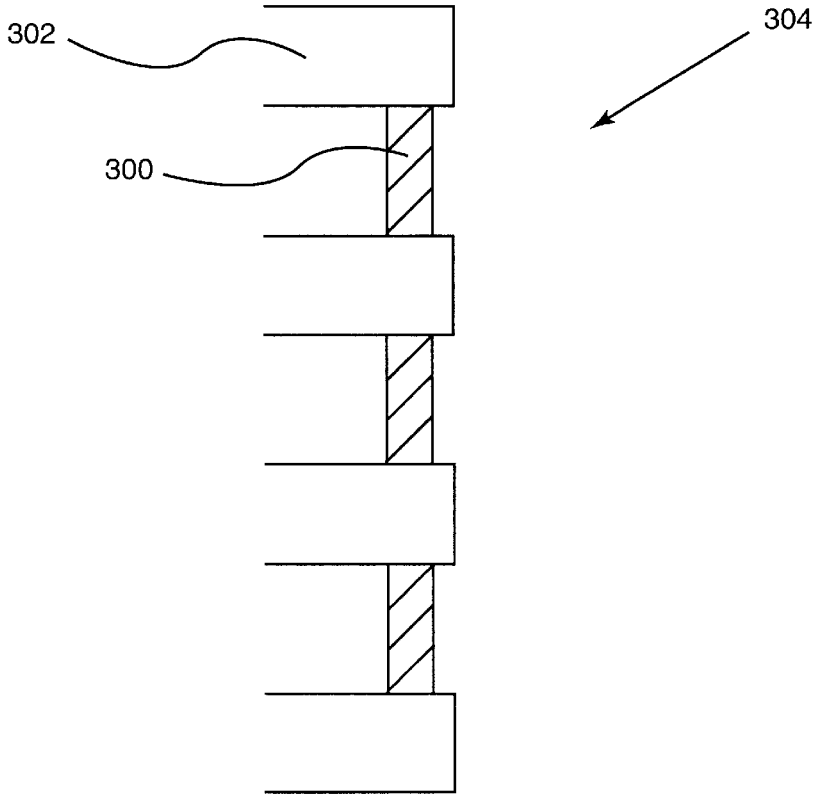
FIG. 10B is a side cross-sectional view of the multi-swirler embodiment of the present invention depicted in FIG. 10A.

FIG. 10 shows a further alternative embodiment using the swirler of the present invention. This multi-port design, similar to those currently used in turbines where multiple burners fire into a single central combustion chamber, provides for multiple weak swirl burners 300 to be mounted in a single manifold 302. These weak-swirl burners may have a single common premixed fuel-air source or may each have individual fuel-air sources. Where the individual burners 300 have individual pre-mixed fuel-air sources, the composite burner 304 may be fired in different patterns in order to distribute the heat produced by the burner. Also, individual burners may be separately shut down, for instance for maintenance, without requiring that the entire composite burner be turned off.

Figure 11:
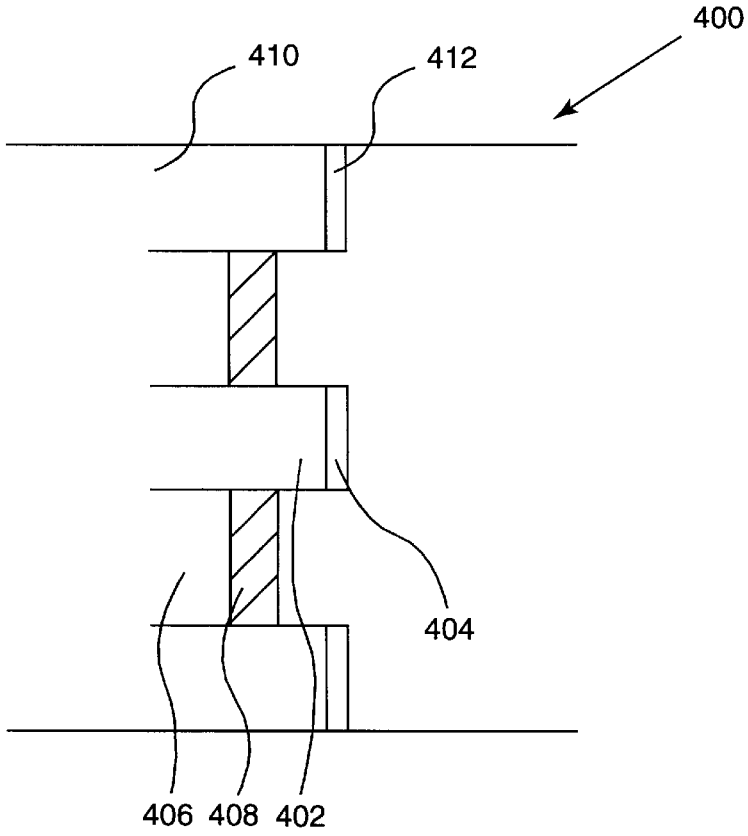
FIG. 11 is a side cross-sectional view of a preferred embodiment of the present invention having an outer, non-swirled annular passage.
Figure 12:
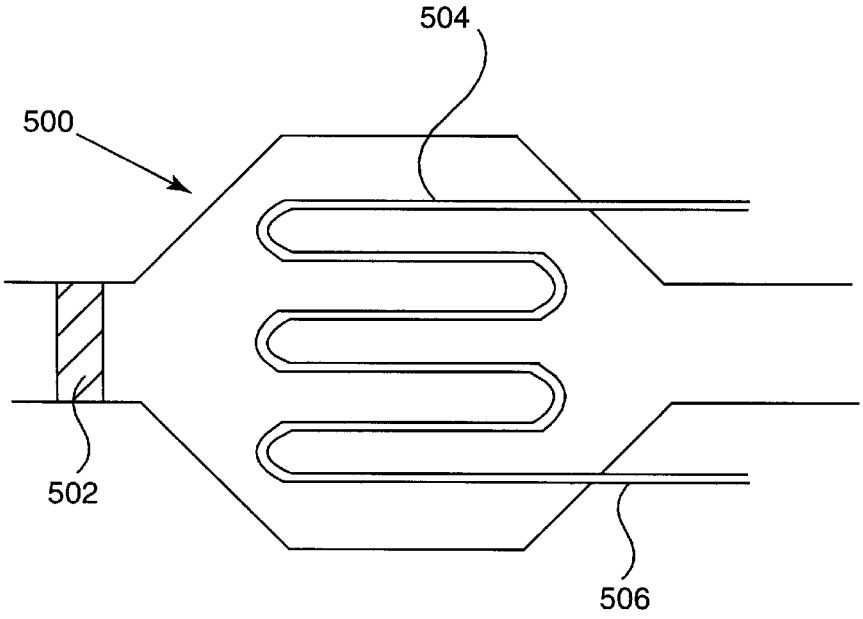
FIG. 12 is a cross-sectional depiction of a heat exchanger embodiment of the present invention.

FIG. 11 shows yet another embodiment incorporating the mechanical swirler weak-swirl burners of the present invention. The burner 400 of this embodiment includes a central passage 402 having a flow balancing insert 404; an annular passage 406 about said central passage 402 having one or more swirl vanes 408 to impart an angular momentum to a feed gas exiting said annular passage; and in addition, a second outer annulus 410 with, or without a flow balancing insert 412. In this embodiment, a fuel-air mixture from a common source is distributed between the three regions of the central passage 402 and the two outer annuli 406, 410. This embodiment is particularly well-suited to the production of long flames, such as those preferred in, for example, gravel dryers and incinerators. FIG. 12 shows a heat exchanger embodiment 500 of the present invention having a heat exchanger 506 in the combustion zone 504 of a burner 502. Heat generated from combustion in the combustion zone 504 may be transferred to a liquid through the heat exchanger 506.

The present invention has been described in terms of several preferred embodiments and sample applications. The invention however is not limited by the embodiments and applications described.

Although specific embodiments of the present invention have been described in detail, it should be understood that the present invention may be embodied in many other specific forms without departing from the spirit or scope of the invention as recited in the claims.

What is claimed is:

1. A mechanical swirler, comprising:

a central passage having an entrance for accepting a premixed feed gas, a flow balancing insert that introduces additional pressure drop beyond that occurring in the central passage without said flow balancing insert, and an exit aligned to direct said feed gas into a combustor; and an annular passage about said central passage and including one or more vanes oriented to impart angular momentum to feed gas exiting said annular passage; and wherein said swirler does not induce recirculation in said feed gas.

2. The mechanical swirler of claim 1, wherein said flow balancing insert comprises a porous material.

3. The mechanical swirler of claim 2, wherein said flow balancing insert comprises a perforated screen.

4. The mechanical swirler of claim 2, wherein said flow balancing insert comprises wire mesh.

5. The mechanical swirler of claim 2, wherein said flow balancing insert comprises a porous ceramic material.

6. The mechanical swirler of claim 2, wherein said flow balancing insert comprises a porous polymeric material.

7. The mechanical swirler of claim 2, wherein said flow balancing insert comprises a porous metallic material.

8. The mechanical swirler of claim 1, wherein said vanes are fixed.

9. The mechanical swirler of claim 8, wherein said vanes are oriented at an angle of about 37° from the vertical.

10. The mechanical swirler of claim 1, wherein said vanes are movable.

11. The mechanical swirler of claim 1, wherein the pitch of said vanes is fixed.

12. The mechanical swirler of claim 1, wherein the pitch of said vanes is adjustable.

13. The mechanical swirler of claim 1, wherein said vanes number eight.

14. The mechanical swirler of claim 1, wherein said annular passage has no outer boundary.

15. The mechanical swirler of claim 1, further comprising a outer annular passage about said annular passage, said outer annular passage having a flow balancing insert that introduces additional pressure drop beyond that occurring in the outer annular passage without said flow balancing insert.

16. A combustor comprising:

a mixer for premixing fuel and oxidant to produce a premixed feed gas;

a swirler located downstream from said mixer and capable of receiving a premixed feed gas from said mixer, said swirler including a central passage having an entrance for accepting a portion of said feed gas, a flow balancing insert that introduces additional pressure drop beyond that occurring in the central passage without said flow balancing insert, and an exit aligned to direct said portion of said feed gas into a combustion zone, and an annular passage about said central passage having an entrance for accepting a second portion of said feed gas, one or more vanes oriented to impart angular momentum to feed gas exiting said annular passage and an exit aligned to direct said second portion of said feed gas into the combustion zone, and wherein said swirler does not induce recirculation in said feed gas; and wherein said combustion zone is capable of supporting combustion of said premixed feed gas.

17. The combustor of claim 16, further comprising an exit tube disposed between the exits of said central and annular passages and said combustion zone.

18. The combustor of claim 17, wherein said combustion zone is above said exit tube.

19. The combustor of claim 17, wherein said combustion zone is within said exit tube.

20. The combustor of claim 16, wherein passage of portions of said feed gas through said central passage and said annular passage imparts a weak swirl to said fuel gas downstream of said swirler.

21. The combustor of claim 20, wherein said weak swirl is characterized by a vane swirl number between about 0.25 and 0.60.

22. The combustor of claim 20, wherein said weak swirl is characterized by a vane swirl number between about 0.27 and 0.58.

23. The combustor of claim 22, wherein said weak swirl is characterized by a vane swirl number between about 0.35 and 0.55.

24. The combustor of claim 23, wherein said weak swirl is characterized by a vane swirl number of about 0.48.

25. The combustor of claim 16, wherein said flow balancing insert comprises a porous material.

26. The combustor of claim 16, wherein said feed gas comprises natural gas and air.

27. The combustor of claim 16, wherein said feed gas comprises propane gas and air.

28. The combustor of claim 16, wherein aid feed gas comprises a pre-vaporized liquid fuel and air.

29. The combustor of claim 16, wherein said feed gas is lean.

30. The combustor of claim 16, wherein heat generated from combustion in said combustion zone is transferred to a liquid through a heat exchanger.

31. The combustor of claim 16, further comprising a turbine through which combustion products from said combustion zone are exhausted in order to generate electricity.

32. A method of combustion, comprising:

mixing a fuel and an oxidant to produce a feed gas;

weakly swirling said feed gas without inducing recirculation therein in a mechanical swirler including a central passage having an entrance for accepting a portion of said feed gas, a flow balancing insert that introduces additional pressure drop beyond that occurring in the central passage without said flow balancing insert, and an exit aligned to direct said portion of said feed gas into a combustion zone, and an annular passage about said central passage having an entrance for accepting a second portion of said feed gas, one or more vanes oriented to impart angular momentum to feed gas exiting said annular passage and an exit aligned to direct said second portion of said feed gas into the combustion zone; and combusting said weakly swirled feed gas in said combustion zone.

33. The method of claim 32, wherein said fuel is natural gas and said oxidant is air.

34. The method of claim 32, wherein said fuel is propane gas and said oxidant is air.

35. The method of claim 32, wherein said flow balancing insert is a porous material.

36. A burner, comprising:

a combustion zone;

a pilot mounted adjacent to said combustion zone, including, a mixer for premixing fuel and oxidant to produce a feed gas;

a mechanical swirler located downstream from said mixer and capable of receiving a premixed feed gas from said mixer, said swirler including a central passage having an entrance for accepting a portion of said feed gas, a flow balancing insert that introduces additional pressure drop beyond that occurring in the central passage without said flow balancing insert, and an exit aligned to direct said portion of said feed gas into a second combustion zone, and an annular passage about said central passage having an entrance for accepting a second portion of said feed gas, one or more vanes oriented to impart angular momentum to feed gas exiting said annular passage and an exit aligned to direct said second portion of said feed gas into the second combustion zone, wherein said swirler does not induce recirculation in said feed gas, and wherein said second combustion zone is capable of supporting combustion of said premixed feed gas; and wherein said pilot is capable of igniting a fuel mixture provided to said combustion zone.

* * * * *